United States Patent [19]

Rohlin

[11] Patent Number: 4,979,761

[45] Date of Patent: Dec. 25, 1990

[54] SKI SUSPENSION

[76] Inventor: William F. Rohlin, 4911 Clinton Rd., Jackson, Mich. 49201

[21] Appl. No.: 407,292

[22] Filed: Sep. 14, 1989

[51] Int. Cl.[5] ..... A63C 5/00

[52] U.S. Cl. ..... 280/607; 280/618

[58] Field of Search ..... 280/607, 11.14, 11.15, 280/11.28, 617, 618

[56] References Cited

U.S. PATENT DOCUMENTS

| | | | |
|---|---|---|---|
| 27,232 | 2/1860 | Mitchell | 280/11.28 |
| 1,351,925 | 9/1920 | Ricke | 280/11.14 X |
| 1,702,316 | 2/1929 | Ridgers | 280/11.15 X |
| 2,330,731 | 3/1942 | Oestreich | 280/607 |
| 2,350,130 | 3/1943 | Rinkinen | 280/607 |
| 3,797,844 | 3/1974 | Smolka et al. | 280/617 |
| 3,917,298 | 11/1975 | Haff | 280/617 X |
| 4,139,214 | 2/1979 | Meyer | 280/607 |
| 4,896,895 | 1/1990 | Bettosini | 280/618 X |

FOREIGN PATENT DOCUMENTS 3602364 7/1987 Fed. Rep. of Germany ... 280/11.14

*Primary Examiner*—Charles A. Marmor
*Assistant Examiner*—Michael Mar
*Attorney, Agent, or Firm*—Beaman & Beaman

[57] ABSTRACT

A suspension for skis including a pair of vertically spaced plates, the lower plate being mounted to the ski and the upper plate having a boot attached thereon. Compression springs interposed between the suspension plates absorb shock and impact, and the suspension includes lateral alignment stabilizers and pivoted links interconnecting the plates which permit vertical movement but restrain the plates against lateral angular variations whereby the pressure applied to the ski edges is maintained during vibration absorbing. A foam material between the plates damps the suspension action and protects the interior components.

7 Claims, 1 Drawing Sheet

SKI SUSPENSION

BACKGROUND OF THE INVENTION

Downhill skiing imposes substantial shock, impact and vibration upon the skier's legs as terrain is traversed. Such impacts and vibration often injure the skier's leg and knee joints, and such injuries limit the duration of a skier's enjoyment of the sport.

Various accessories and attachment for skis have been proposed which would absorb shocks and impact occurring during skiing and typical devices of this nature are shown in U.S. Pat. Nos. 2,330,731; 2,350,130; 3,917,298; and 4,139,214. However, prior art devices capable of absorbing vibration and impact during skiing do not provide the necessary stabilization and "feel" required by the skier during maneuvers, and ski suspension devices have not come into popular use.

Known ski suspension devices have utilized springs and air cushions for absorbing shocks and vibration imposed on the ski, but existing ski suspensions have not been capable of effectively absorbing such forces while also providing effective ski control, particularly with respect to the regulating of the desired forces to the lateral edges of the skis during maneuvering.

It is an object of the invention to provide a suspension for skis which is of concise configuration, capable of absorbing and damping vibration and impact imposed on the ski without transfer to the skier's legs, and which does not adversely interfere with the control of the ski.

An additional object of the invention is to provide a ski suspension which is relatively economical to manufacture, stabilizes the ski and improves tracking during turns.

An additional object of the invention is to provide a ski suspension which effectively absorbs and damps vibration and yet permits lateral forces applied to the suspension by the skier to be effectively transmitted to the ski edges.

In the practice of the invention the ski suspension comprises an assembly which is attached to the upper surface of a conventional downhill snow ski at the center of the ski at the location at which the bindings are normally attached. The suspension assembly includes a pair of upper and lower plates normally maintained in spaced parallel relationship, the lower plate being affixed to the ski, and the upper plate having the binding attached thereto.

The upper and lower plates have a plurality of compression springs interposed therebetween for absorbing the vibrations imposed on the ski and lower plate during use, the springs preventing the shock forces and vibrations from being transmitted to the upper plate. Posts are interposed between the plates to aid plate alignment and the posts and upper plate are relatively moveable to prevent the posts from interfering with the shock absorbing action.

A plurality of links or hinges are interposed between the upper and lower plates which permit the plates to move relative to each other in a vertical direction, but maintain a predetermined lateral orientation whereby the skier's weight can be effectively transferred to the ski edges as is necessary during maneuvering. The links include a pivot operative about an axis fixed with respect to the lower plate, and an upper pivot axis adjacent the upper plate is relatively displaceable with respect to the upper plate in the direction of the length of the upper plate parallel to the lateral edges of the plates and ski. This mounting of the links prevents interference of the hinges with respect to the relative vertical movement of the plates while permitting lateral forces imposed upon the upper plate by the skier to be directly transferred to the lower plate and the ski edges.

A compressible elastic foam material is also located between the plates having a plurality of voids or chambers defined therein. The chambers receive the compression springs, posts and hinges and the foam material functions as a gasket to protect these components from direct contact with snow and moisture, and simultaneously, the foam material functions as a shock absorber and damper between the plates which does not interfere with the shock absorbing aspects of the suspension, but provides improved "feel" and control during relative plate movement.

The aforedescribed relationships of components results in a ski suspension capable of effectively reducing shock and vibration which would otherwise be directly imposed upon the skier's legs and joints, and the suspension reduces leg fatigue and joint and back strain. The ski suspension stabilizes the ski reducing the effort normally exerted by leg muscles for turning and maintaining balance, and a smoother and firmer ride results, tracking is improved during turning for improving maneuverability and speed, and as fewer vibrations and impacts are transmitted to the bindings fewer occurrences of inadvertent binding release result.

BRIEF DESCRIPTION OF THE DRAWINGS

The aforementioned objects and advantages of the invention will be appreciated from the following description and accompanying drawings wherein.

BRIEF DESCRIPTION OF THE PREFERRED EMBODIMENT

Figure 1:
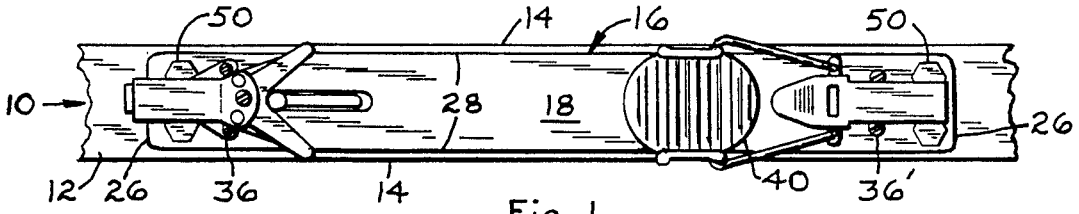
FIG. 1 is a top elevational view of the midsection of a snow ski illustrating the ski suspension of the invention having bindings mounted thereon.

A ski suspension constructed in accord with the inventive concepts for only a single ski is shown in the drawings, it being understood that both skis of a pair would be equipped with an identical suspension. While the suspension of the invention is particularly utilized in downhill skiing wherein maximum shock and vibrations occur, it is possible to use the suspension for other types of skis, such as of the cross country variety. In the drawings a single downhill ski 10 is illustrated having an upper surface 12 and parallel longitudinal edges 14, which are usually metal clad for forming a cutting edge for penetrating the snow during maneuvering, as is well known.

The suspension assembly 16 includes an upper plate 18 and a lower plate 20. Each of the plates is generally planar in configuration and the lower plate 20 includes ends 22 and parallel lateral edges 24, while the upper plate includes ends 26 and parallel lateral edges 28. As is readily appreciated from the drawings, the longitudinal length and axis of the assembly 10 is parallel to the lateral edges 24 and 28. The plates 18 and 20 are usually formed of metal, but may also be formed of a high strength epoxy with glass fiber reinforcement as such material is strong, rigid and light.

Figure 2:
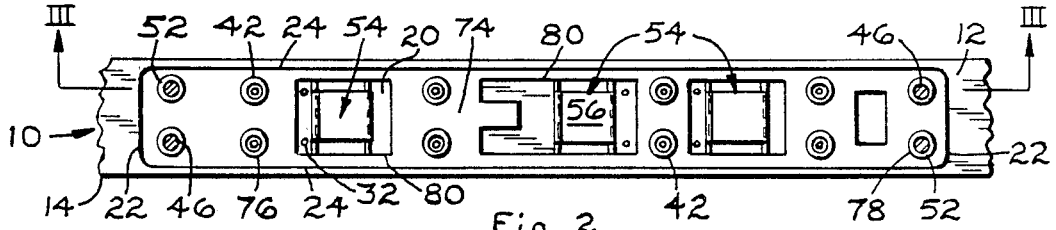
FIG. 2 is a top plan view of the ski suspension with the upper plate removed.
Figure 4:
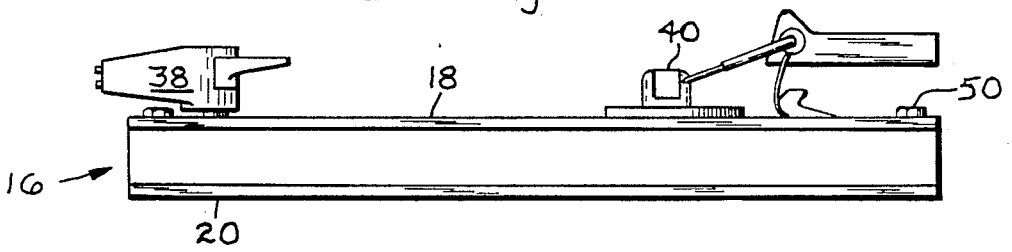
FIG. 4 is a side elevational view of the ski suspension assembly, per se, having bindings mounted thereon.

Holes 30 are provided in the lower plate 20 to provide means for attaching the lower plate firmly to the ski upper surface 12 by bolts, screws or other conventional fasteners 32, FIG. 2. Holes 34 are defined in the upper plate 18 to receive the screws 36, FIG. 1, of the bindings for attaching the bindings to the upper surface of the plate 18. As best apparent from FIGS. 1 and 4, the bindings consist of the typical toe clamp 38 attached to the plate 18 by screws 36, and the heel clamp 40 is attached to the plate by screws 36'. The particular construction of the bindings constitutes no part of the present invention and the suspension disclosed may be utilized with all types of ski bindings.

The plate 18 is superimposed above the plate 20 wherein the lateral edges 24 are located directly below a lateral edge 28 as is apparent from FIGS. 5 and 6. The plates 18 and 20 are in a spaced parallel relationship to each other, and a predetermined angular relationship is desired to be maintained between the plates 18 and 20 in a direction lateral to the longitudinal lengths of the plate and suspension assembly. Usually, this orientation is the maintaining of the plate 18 parallel to the plate 20 in both a longitudinal and lateral manner. However, it is foreseeable that it may be desirable to have a slight angular deviation between the plates laterally, to accommodate right and left feet, and such in instance the plates 18 and 20 would be generally parallel in the longitudinal direction, but the plates would have a slight angular orientation with respect to each other in the lateral direction.

Figure 3:
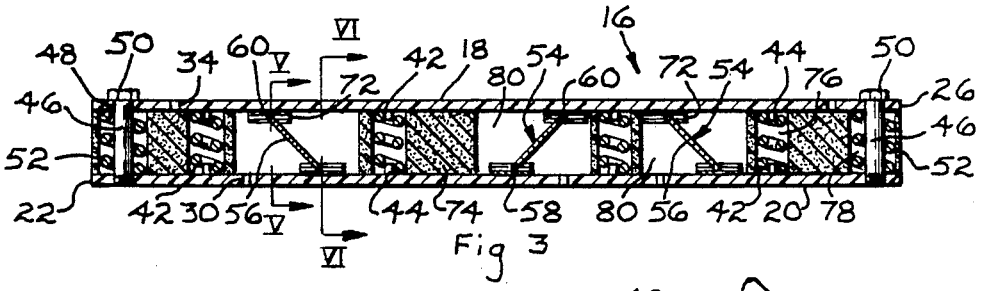
FIG. 3 is an elevational sectional view as taken along Section III—III of FIG. 2.

The spacing between the plates 18 and 20 is maintained by a plurality of coiled compression springs 42, eight of which are shown in the disclosed embodiment. The compression springs 42 are each provided with a positioning stud 44, FIG. 3, extending from the upper and lower plates into the spring coils in order to maintain the orientation of the springs, and the length of these studs is short so as not to engage when the suspension is under heavy compression.

Alignment between the plates 18 and 20 is augmented by the use of four headed columns 46 each having a lower end which is attached to the lower plate 20. The columns 46 may be threaded into threaded holes defined in the plate 20 and the upper ends of the columns slidably extend through holes 48 defined in the upper plate 18, and enlarged hexagonal heads 50 overlap the upper plate and limit the extent of the separation of the plates. A compression spring 52 surrounds each of the four columns 46 bearing upon the plates 18 and 20 endeavoring to separate the plates, and the springs 52, in addition to the springs 42 tend to bias the plates away from each other.

With a ski suspension it is important that the skier be able to control the application of weight to the ski edges 14, and such weight distribution is achieved by the lateral leaning of the body so as to vary the direction of the application of forces on the binding and to the ski. In order to transfer the desired ski edge loading through the bindings to the ski edges 14 the assembly suspension 16 utilizes a plurality of lateral load transfer links or hinges 54 interposed between the plates. In the disclosed embodiment three such links 54 are disclosed.

Figure 5:
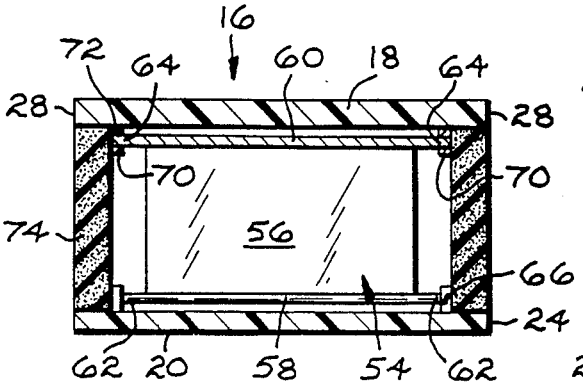
FIG. 5 is an elevational sectional view taken through an upper link pivot axis along Section V—V of FIG. 3.
Figure 6:
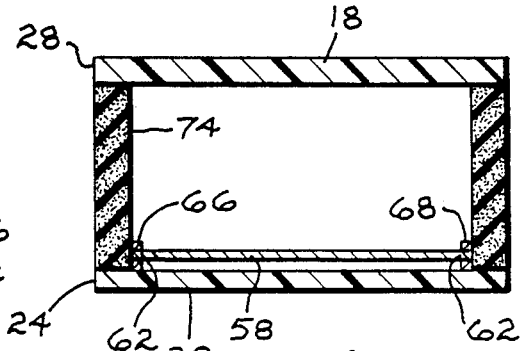
FIG. 6 is an elevational section view taken through a lower link pivot axis along Section VI—VI of FIG. 3.

The links or hinges 54 each consist of a flat plate 56 of a substantially rectangular configuration as will be appreciated from FIGS. 2 and 5 which forms a lever. A cylindrical pivot shaft 58 is affixed to the lower end of the plate 56, while a cylindrical pivot shaft 60 is attached to the upper end of the plate. The lower shaft includes end portions 62 which extend beyond the link plate end edges, and in a similar manner the upper pivot shaft includes end portions 64 which also extend beyond the plate ends. It is to be noted from the drawings that the end portions on each pivot shaft are spaced apart a distance substantially equal to the width of the assembly 10, and this spacing provides the optimum application of lateral forces. A bracket 66 is affixed to the lower plate 20 and includes holes 68 for rotatably receiving the end portions 62 of the shaft 58, and in this manner the lower end of the link plates 56 is pivotally connected to the lower plate 20.

A bracket 70 is attached to the underside of the upper plate 18, and the bracket 70 includes elongated slots 72 defined therein for receiving the ends 64 of the pivot shaft 60. The slots 72 extend in the longitudinal direction of the plate 18 and the suspension assembly and permits movement of the pivot shaft 60 in the direction of the suspension assembly length and also supports the shaft in a pivotal manner. As will be appreciated from the drawings, the axes of the pivot shafts 58 and 60 are substantially perpendicular to the length of the plates 18 and 20 and suspension assembly. Accordingly, as the distance separating the plates 18 and 20 varies the links 54 hinge about the pivot shafts 58 and 60, but because the pivot shaft 60 is capable of sliding within the bracket slots 72 the links do not interfere with the relative movement of the plates 18 and 20 toward and away from each other. However, the links 54, prevent a twisting of the plates 18 and 20 in a lateral direction about the central longitudinal axis of the suspension, and the links 54 maintain a predetermined angular relationship between the plates 18 and 20 in the lateral direction. The links 54 permit the skier to transfer his weight to the ski edges 14 by lateral leaning and the links will maintain the desired predetermined angular orientation of the plates in the lateral direction regardless of the spacing between the plates.

A resilient synthetic foam material 74 is interposed between the plates 18 and 20 and functions as a gasket to protect the suspension components located between the plates from snow, water, and foreign matter and the foam material also serves to absorb and damp the transfer of vibration and forces between the plates and. As will apparent from FIG. 3, the foam material 74 extends fully between the plates, and a plurality of voids 76 are defined in the foam material for receiving the springs 42, the voids 78 receive the columns 46 and springs 52, and the larger rectangular voids receive the link hinges 54 and the associated brackets. As will be appreciated from FIG. 4, at its lateral edges the foam material is continuous and fully encloses the springs, columns and link hinges.

In operation, a ski assembly 16 is mounted upon each ski 10 at the normal location of binding attachment, the lower plate 20 being attached to the ski while the bindings 38 and 40 are attached to the upper plate 18. The ski boot, not shown, is mounted in the bindings in the normal manner and the skier's weight is carried by the plate 18. As the plate 18 is supported by springs 42 and 52 the skier's weight is supported upon the springs and as the skier traverses the run vibrations imposed upon the ski will not be directly transmitted to the skier, but will be absorbed and damped by the springs 42 and 52. Additionally, the presence of the foam material 74, which will always be under a state of compression, damps movements of the springs and also helps to support the skier's weight.

The ski suspension 10 does not affect the control imposed upon the skis by the skier as the presence of the link hinges 54 are very effective in permitting the skier to transfer lateral forces through the ski boot to the ski edges 14. The mounting of the link hinges 54 permits such lateral loading without adversely affecting the movement of the plates 18 and 20 toward and away from each other, and the construction, location and utilization of the components permits a ski suspension to be provided which is of low profile, attractive, high strength and yet effective for its intended purpose.

It is appreciated that various modifications to the inventive concepts may be apparent to those skilled in the art without departing from the spirit and scope of the invention. For instance, the slots 72 could be formed in lower brackets 66 rather than upper brackets 70, the spring location studs 44 could be replaced by recesses in plates 18 and 20 for receiving springs 42, and the springs 52 could be eliminated as their use is optional. Also, it is to be appreciated that the disclosed suspension could be incorporated into the sole of a ski boot with few modifications.

I claim:

1. A ski suspension for attachment to the upper surface of a ski having longitudinal edges comprising, in combination, an elongated suspension assembly including elongated upper and lower plates each having lateral edges, and a length, said upper plate being superimposed over said lower plate in spaced relationship whereby the lateral edges of said upper plate are maintained in a predetermined vertical relationship with the lateral edges of said lower plate, means for attaching said lower plate to the ski upper surface, means for mounting ski bindings to said upper plate, spring means interposed between said plates entirely supporting the weight of a skier applied to said upper plate, and lateral load transfer means interposed between said plates for maintaining each of the lateral edges of said upper plate and the respective lateral edges of said lower plate at the same vertical relationship while permitting independent vertical movement of said front and rear edges of said upper plate relative to said front and rear edges of said lower plate, said lateral load transfer means comprising a plurality of links interposed between said plates, each of said links having first pivot means having a first axis connected to one of said plates and a second pivot means having a second pivot axis connected to the other plate, said links' pivot axes being substantially perpendicular to the length of said suspension assembly, pivot support means mounting at least one of said pivot means of a link on its associated plate to permit translation of said one pivot means on said associated plate in the direction of the length of said suspension assembly.

2. In a ski suspension as in claim 1, said links comprising a lever having first and second ends, said first and second pivot means being located at said first and second lever ends, respectively, each of said pivot means including a pair of spaced bearings, the spacing between the bearings of a common pivot means being substantially equal to the width of said suspension assembly as defined by the spacing between said lateral edges of a plate.

3. In a ski suspension as in claim 2, wherein pivot bearing brackets are mounted on said first and second plates receiving said bearings.

4. In a ski suspension as in claim 3, at least one pair of said bearing brackets being associated with a common end of said lever and said pivot support means comprise lost motion means associated with the adjacent pivot means permitting movement of said adjacent pivot means in the direction of the length of said assembly.

5. In a ski suspension as in claim 1, including a compressible resilient foam interposed between said plates for damping and absorbing vibrations between said plates.

6. In a ski suspension as in claim 1, a compressible resilient foam interposed between said plates for damping and absorbing vibrations between said plates, voids defined in said foam material, said spring means and said links being located within said voids whereby said foam and said plates enclose said spring means and links.

7. A suspension for skiing for skis having longitudinal edges comprising, in combination, an elongated suspension assembly including elongated upper and lower plates each having lateral edges, front and rear edges, and a length, said upper plate being superimposed over said lower plate in spaced relationship whereby the lateral edges of said upper plate are maintained in a predetermined vertical relationship with the lateral edges of said lower plate, spring means interposed between said plates entirely supporting the weight of a skier applied to said upper plate, and lateral load transfer means interposed between said plates for maintaining each of the lateral edges of said upper plate and the respective lateral edges of said lower plate at the same vertical relationship while permitting independent vertical movement of said front and rear edges of said upper plate relative to said front and rear edges of said lower plate and permitting the lateral application of forces to the ski's lateral edges, said lateral load transfer means comprising a plurality of links interposed between said plates, each of said links having first pivot means having a first axis connected to one of said plates and a second pivot means having a second pivot axis connected to the other plate, said links' pivot axes being substantially perpendicular to the length of said suspension assembly, pivot support means mounting at least one of said pivot means of a link on its associated plate to permit translation of said one pivot means on said associated plate in the direction of the length of said suspension assembly.

* * * * *

UNITED STATES PATENT OFFICE

CERTIFICATE OF CORRECTION

Patent No. 4,979,761 Dated December 25, 1990

Inventor(s) William F. Rohlin

It is certified that error appears in the above-identified patent and that said Letters Patent is hereby corrected as shown below:

Column 5, line 37, after "edges," and before "and", insert -- front and rear edges --.

Signed and Sealed this

Seventh Day of April, 1992

*Attest:*

HARRY F. MANBECK, JR.

*Attesting Officer*

*Commissioner of Patents and Trademarks*